US008718816B2

(12) United States Patent
Sutter et al.

(10) Patent No.: US 8,718,816 B2
(45) Date of Patent: May 6, 2014

(54) CONCEPT FOR INCREASING EFFICIENCY OF ROBOTIC PACKAGING INSTALLATIONS

(75) Inventors: Lukas Sutter, Neukirch (CH); Hans-Peter Kientz, Singen (DE); Andreas Baechle, Rickenbach (DE)

(73) Assignee: Robert Bosch GmbH, Stuttgart (DE)

( * ) Notice: Subject to any disclaimer, the term of this patent is extended or adjusted under 35 U.S.C. 154(b) by 49 days.

(21) Appl. No.: 13/389,695

(22) PCT Filed: Aug. 3, 2010

(86) PCT No.: PCT/EP2010/061265

§ 371 (c)(1),
(2), (4) Date: Apr. 27, 2012

(87) PCT Pub. No.: WO2011/018392

PCT Pub. Date: Feb. 17, 2011

(65) Prior Publication Data

US 2012/0209423 A1 Aug. 16, 2012

(30) Foreign Application Priority Data

Aug. 11, 2009 (DE) ..... 10 2009 028 441

(51) Int. Cl.
*G06F 7/00* (2006.01)
*G06F 19/00* (2011.01)

(52) U.S. Cl.
USPC ..... 700/230; 700/223; 700/213; 700/219; 700/228

(58) Field of Classification Search
None
See application file for complete search history.

(56) References Cited

U.S. PATENT DOCUMENTS

| | | | | |
|---|---|---|---|---|
| 6,122,895 | A * | 9/2000 | Schubert | 53/55 |
| 2003/0182898 | A1 | 10/2003 | Huppi et al. | |
| 2009/0320416 | A1 | 12/2009 | Tischhauser | |
| 2010/0249992 | A1 * | 9/2010 | Grundtvig et al. | 700/223 |

FOREIGN PATENT DOCUMENTS

| | | |
|---|---|---|
| EP | 0749902 | 12/1996 |
| EP | 0856465 | 8/1998 |
| EP | 1359099 | 11/2003 |
| EP | 1717150 | 11/2006 |

OTHER PUBLICATIONS

PCT/EP2010/061265 International Search Report dated Dec. 14, 2010 (2 pages).

* cited by examiner

*Primary Examiner* — Yolanda Cumbess
(74) *Attorney, Agent, or Firm* — Michael Best & Friedrich LLP

(57) ABSTRACT

The invention relates to a method for moving piece goods from at least one piece goods conveyor (12) running in a transport direction (x) into placement positions of at least one placement position conveyor (14, 16) running in the same or opposite transport direction (+x', −x') as the transport direction (x) of the piece good conveyor(s) (12) in a robot processing line, having robots (18) disposed at least on one side of a centerline (m) of the piece goods conveyor (12) of a width, wherein the piece goods are picked from the piece goods conveyor(s) by means of the robots (18) and placed in placement positions on the placement position conveyors (14, 16). At least part of the piece goods are transported transverse to the transport direction (x) of the piece goods conveyor(s) (12) when transiting the robot line (10) at a location of the robot line (10) into the pick region of the robots (18) disposed on the other side of the longitudinal centerline (m) of the piece goods conveyor(s) (12).

13 Claims, 3 Drawing Sheets

CONCEPT FOR INCREASING EFFICIENCY OF ROBOTIC PACKAGING INSTALLATIONS

BACKGROUND OF THE INVENTION

The present invention relates, in general, to a concept for increasing the efficiency of linear robotic packaging installations during normal operation and in the event of certain installation parts failing. In particular, the invention relates to a method by means of which articles from at least one article conveyor, which runs in a transporting direction, are transferred into set-down positions of at least one set-down-position conveyor, which runs in the transporting direction which is the same as, or counter to, the transporting direction of the article conveyor/s, in a robot processing line with robots arranged, in the case of set-down-position conveyors on either side, preferably on either side of a longitudinal center of the article conveyor/s of a certain width or, in the case of a set-down-position conveyor on one side, preferably to the side of the longitudinal center of the article conveyor/s of a certain width, wherein the robots pick the articles from the article conveyor/s and set them down in set-down positions on the set-down-position conveyors. The invention also covers an installation for implementing the method.

Products such as, for example, biscuits, sponge cakes or chocolate products, are frequently intended to be set down in ordered fashion at predetermined locations of a pack or of a feeding system of a following packaging installation. Examples are the ordered setting down of products in plastic trays, which are then usually additionally wrapped in a tubular bag and/or cardboard packaging or closed by a cover sheet, and in some cases provided with further packaging, or also the direct setting down of products in a feeding system such as, for example, a feeding chain or a feeding belt of a packaging installation. If the products are introduced into packs, then these can be fed to the installation or even produced directly on the packaging installation.

The products here may come directly from an upstream production process or a store, wherein, for reasons relating to safeguarding the product, hygiene and the production costs, packaging takes place usually directly following the production process. Frequently alternating products require packaging installations with an extremely high level of flexibility.

In particular the following two installation concepts are customary for packaging large-volume product streams:

A parallel arrangement of container conveyor/chain and product stream. Loading of the containers or of some other removal system, e.g. a chain, takes place preferably from two sides in counterflow, or in uniflow, operation. Counterflow operation is mostly advantageous here since it can achieve a relatively high installation capacity. Such an installation is known, for example, from U.S. Pat. No. 6,122,895. A corresponding installation has been combined in EP-A 1 717 150 with an installation for producing and for closing plastic trays.

Since the output of robots increases as the distances which a robot has to cover decrease, usually in each case two robots are arranged in pairs over the width of the product stream, wherein one robot clears away the products from the left-hand half of the product stream into a removal system on the left-hand side of the installation and one robot clears away the products from the right-hand half of the belt onto a removal system on the right-hand side of the product stream. The streams of filled containers are fed, for example, to two tube-packaging machines, which each provide the containers on the left-hand and right-hand sides of the installation with further packaging. The parallel arrangement allows a compact construction with a good system overview.

An alternative to this is provided by the variant in which the product stream and removal conveyor are arranged perpendicularly to one another. The robots here are arranged in cells, which set down the products in each case on a removal apparatus arranged transversely above the product stream. This arrangement likewise makes it possible to realize short pick & place distances. A significant disadvantage of this arrangement, however, is the large amount of space required, in particular in the case of installations with a high capacity and a large number of robots—installations with over 24 robots are known. In particular, each robot, in the case of this type of installation, has its own removal system. Since it is usually the case that the output of a single robot is too low to make full use of the following installation, these removal-conveyor streams have to be guided together again, which additionally increases the size of the installation. If the products are placed into containers, e.g. trays, these have to be fed separately for each robot.

The aforementioned disadvantages therefore mean that, in particular, in the case of large installations with a multiplicity of robots, the parallel arrangement of product stream and container stream (possibly removal-conveyor stream) is preferred, in particular in so-called counterflow operation. For reasons relating to output, as explained above, the robots are arranged preferably in pairs, and therefore one robot processes the left-hand half, and one robot processes the right-hand half, of the product stream.

One disadvantage of this arrangement, however, is that, during stoppage of one of the two removal systems, as often occurs briefly, for example, in the event of malfunctioning in the corresponding packaging system downstream or if, for example, a roll of packaging material has to be replaced, half the products cannot be packaged since the robots cannot reach the products on the opposite side of the product stream. Mostly, it is therefore necessary to stop the entire installation, or the products pass into the "overflow" and are thus usually lost. Stopping the installation is problematic, in particular, when the products are received directly from one production process, since the latter—e.g. sponge-cake baking—cannot easily be interrupted. This scenario, however, is usually the rule for this type of installation. This means that the products on that half of the installation where the removal system is stationary are lost.

If this is to be avoided, the installation can be supplemented by a storage system which receives the products during stoppage of the installation. Since the product stream can only be stopped in full, this means, however, that, if half the product stream cannot be packed because a removal system has been stopped, production has to be redirected as a whole into the store. The store has to be correspondingly large, which, in addition to the amount of space, investment and maintenance required, also means that a correspondingly long period of time is required until the products from the store are packaged when the installation is operating again. Since, in addition to the products from the store, it is also the case that packaging for current production has to continue, the installation, in addition, has to have a fairly large excess capacity in order to be able to work through a large store in addition to normal production.

An obvious solution to this problem would be to divide up the product stream, upstream of the packaging installation, into two "narrower" streams, which are processed by two narrower packaging installations, which manage without paired robots and each have just one removal system. This procedure, however, results in significantly larger and more cost-intensive installations.

Lower-capacity installations, in which just one removal system is present on one side of the installation, are also known. In the case of these installations, the robots, mostly, are arranged such that they can pick products from the entire width of the product stream and set them down on the removal system. If the product stream is wide, the necessary picking distances are correspondingly long.

SUMMARY OF THE INVENTION

The invention is based on the object of providing a method of the type mentioned in the introduction and an installation which is suitable for implementing the method and does not have the aforementioned disadvantages of prior art installations. In particular, the installation should be capable of continuing packaging operation during brief stoppage of a removal system—with correspondingly reduced capacity—without it having to be stopped completely. The number of products which go into an "overflow" here, or have to be stored for later processing, should thus be kept as small as possible.

The object is achieved according to the invention, in respect of the method, in that during passage through the robot processing line, at least some of the articles, at one location of the robot processing line, are transported, transversely to the transporting direction of the article conveyor/s, into the picking region of the robots arranged on the other side of the longitudinal center of the article conveyor/s.

The proposed solution is derived from the type of installation with a parallel arrangement of product stream and removal system, preferably working in counterflow operation, with robots arranged in pairs, since this type of installation, as described above, in particular in the case of very large installations, promises the best efficiency.

In order for it to be possible, during stoppage of one of the two removal systems, as required, still to carry out packaging operation for the entire product stream—with reduced capacity—the products on that side of the installation where the removal system is stationary have to be brought to the opposite side, and therefore they pass into the operating range of the robots with the removal system which is operating. The solution according to the invention thus consists in an installation in which the products en route through the installation can be brought from the one side of the product stream onto the opposite side.

One solution is that the articles located in the operating range of the robots arranged on the side of a stationary set-down-position conveyor are brought by these robots into the operating range of the robots of the operating set-down-position conveyor. The robots on the side with the stationary removal system can set down the products in the vicinity of the center of the product conveyor, and therefore these products can likewise be reached from the robots on the other side, in the case of the operating range overlapping. It is also the case with this solution, however, that these robots have to cover a long pick-&-place distance, since all the products have to be picked in the vicinity of the center of the belt. This therefore likewise gives rise to a low output. In addition, the necessary pick-&-place strategies—to which quick changeover has to be made during brief stoppage of a removal system—are fairly complex.

It is preferred for the at least some of the articles to be transported at least into the region of the longitudinal center, preferably from the one side to the other side of the longitudinal center, of the article conveyor/s.

Transportation in the direction transverse to the transporting direction of the article conveyor/s can be carried out by means of a transporting system or by means of transporting systems which cross over one another.

Transportation in the direction transverse to the transporting direction of the article conveyor/s can be carried out on a permanent basis or else only during, or just prior to, stoppage of one side of the installation or of a set-down-position conveyor.

In the case of an advantageous way of implementing the method according to the invention, the robots pick essentially articles in peripheral regions of the article conveyor/s, and transportation of the articles in the direction transverse to the transporting direction of the article conveyor/s is utilized for displacement out of a region on either side of the longitudinal center of the article conveyor/s into the peripheral regions of the article conveyor/s. The width of the peripheral regions expediently corresponds approximately to a quarter of the width of the article conveyor/s.

The method according to the invention also makes it possible to process different products, i.e. to introduce different products into a container, in that at least two different articles are transported simultaneously on the article conveyor/s—for example two or more different products, a product A or a plurality of different products on the left-hand half of the article conveyor and a product B or a plurality of different products on the right-hand half—and the robots upstream of that location of the robot processing line at which the articles are transported, transversely to the transporting direction of the article conveyor/s, into the picking region of the robots arranged on the other side of the longitudinal center of the article conveyor/s pick articles at least of a first type, and set them down in a corresponding number of first set-down positions on the set-down-position conveyors, and the robots downstream of that location of the robot processing line at which the articles are transported, transversely to the transporting direction of the article conveyor/s, into the picking region of the robots arranged on the other side of the longitudinal center (m) of the article conveyor/s pick articles at least of a second type, and set them down in a corresponding number of second set-down positions on the set-down-position conveyors. This procedure allows straightforward packaging of so-called assortment containers.

An installation which is suitable for implementing the method comprises a robot processing line with at least one article conveyor, which runs in a transporting direction, and at least one set-down-position conveyor, which runs in the transporting direction which is the same as, or counter to, the transporting direction of the article conveyor/s, wherein the robots, for picking the articles from the article conveyor/s and setting them down in set-down positions on the set-down-position conveyors, are arranged on either side of a longitudinal center of the article conveyor/s of a certain width. One location of the robot processing line has at least one transporting system for transporting the articles, transversely to the transporting direction of the article conveyor/s, into the picking region of the robots arranged on the other side of the longitudinal center of the article conveyor/s. Transporting systems which cross over one another are preferably provided.

For this purpose, the transporting system of the product stream is interrupted and use is made of at least one interim transporting system, by means of which the product stream on the left-hand half is brought to the right-hand half, and vice versa. The interim transporting systems may be followed, in turn, by a transporting system over the entire width of the installation. It is also possible, following the crossover, to continue with two separate transporting systems for each half of the installation, it being possible for these to be stopped separately in the event of further disruption.

Transporting systems which can realize such a side-to-side changeover are known. For example, multi-level belts are used for this purpose. Multi-level belts can also be used to realize different product-stream runs, it being possible to switch over between these if required.

A preferred transporting system is one which has a permanent crossover. Despite the product flow not running "rectilinearly", this solution gives advantages both during normal operation of the set-down-position conveyors and during stoppage of one half of the installation.

A transporting system with a crossover is easy to realize and is not associated with the disadvantages of multi-level belts, such as high costs and complexity and a large amount of installation space. Such a solution renders the packaging installation only slightly longer and does not require any further measures apart from a small gap having to be ensured in the longitudinal center of the product stream upstream of the crossover location.

It is thus proposed, in a preferred embodiment, to implement a fundamental, i.e. permanent, side-to-side changeover, irrespective of whether one of the removal systems has just been stopped or whether both systems are active.

As an additional advantage, the products which were located in the vicinity of the center of the product stream are located, following the side-to-side changeover, in the vicinity of the periphery, which means a short pick-&-place distance for the following robots since they are then already located in the vicinity of the removal system.

It is thus an advantageous strategy, in the case of the installation according to the invention, for the robots always to pick products in the outer quarter of the product stream. The products in the inner half of the product stream need not be picked since, following the crossover, they end up automatically located in the two outer quarters.

This means that pick-&-place distances in the case of the installation according to the invention, during normal operation, are considerably shorter, on average, than in the case of an installation which does not provide for any side-to-side changeover of the products, and this results in considerably increased installation capacity. The crossover thus also gives advantages during normal operation.

If a removal system is stationary, the installation can still package all the products with the reduced capacity. If production cannot be reduced correspondingly, and if the excess products are stored on an interim basis in a storage system, these excess products in the storage system can be processed quickly alongside normal production—in particular also as a result of the greater capacity reserves of an installation with side-to-side changeover on account of the shorter picking distances mentioned above.

Furthermore, it is also conceivable to have a variant in which the removal system, rather than the product stream, has a crossover. It would thus be possible, even if a removal system is stationary, for the entire product stream to be packaged, although this would not have a positive effect on the pick-&-place distances.

Further advantages of the side-to-side changeover are:

Relatively wide product streams can be cleared away by means of small robots, since the robots need not reach into the center of the transporting system.

The robots, geared to short distances and high speed, are utilized to the optimum extent.

Increased output means that the number of robots is reduced, and this results in an installation which is more compact and cost-effective.

The solution with a fixed crossover of the transporting system combines the advantages of all the possible solutions presented, reduces the disadvantages thereof and, even during normal operation, gives the following advantages:

Products can always be cleared away over an optimally short displacement distance. The side-to-side changeover results in a small operating range for the robots; wide belts can be cleared by means of small robots.

The operating ranges of the robots are utilized to the optimum extent; cutting back on the number of robots results in a reduction in costs.

There is no need for any individual robots with a large operating range; this results in a compact and uniform installation.

Single-sided operation, e.g. just on one branch of a tube-packaging machine, is readily possible.

The following advantages are achieved during stoppage of part of an installation:

During stoppage of a packaging machine, supply to the side which is operating can take place to the full extent. Production of approximately 60% is possible, and production of up to 100% is possible, depending on the excess-processing capacity.

A straightforward control strategy is achieved since the operating mode always remains the same, even in the event of a packaging machine failing.

During planned stoppage, a changeover to the other side is possible essentially without any waste.

During stoppage which is not overly long on one side, the associated transporting system can be utilized as an additional buffer store.

A further advantage of the installation according to the invention consists in that, during stoppage on one side, it is possible not just to deal better with disruption; it is also possible for one side to be stopped intentionally, e.g. for the purpose of cleaning or format changeover, and for production to continue on the second side, possibly with correspondingly reduced capacity. If the one side has been cleaned or rearranged, this can take place on the second side. This means that there are fewer instances of production breaking down, which significantly increases the availability of the installation.

Furthermore, it is also possible for the present installation to reduce the buffer-storage size or distance of a following packaging installation in that, downstream of the crossover, the article conveyor, which then corresponds only to part of the width, preferably half the width, of the article conveyor upstream of the crossover, can be controlled individually in respect of speed and can thus perform a kind of buffer-storage function. This has the advantage that the buffer store of the following packaging installation can be reduced in size and it is thus possible to make savings in terms of space and costs.

A further possibility of this installation consists in that it is possible to use the article conveyor, downstream of the crossover, to perform a spreading function in the direction of operation, i.e. to allow this conveyor to operate at a higher speed than the preceding one, in order to draw the products apart from one another.

BRIEF DESCRIPTION OF THE DRAWINGS

Further advantages, features and details of the invention can be gathered from the following description of preferred exemplary embodiments and with reference to the drawings, which serves merely for explanatory purposes and should not be interpreted as having any limiting effect. In the drawings, schematically.

DETAILED DESCRIPTION

Figure 1:
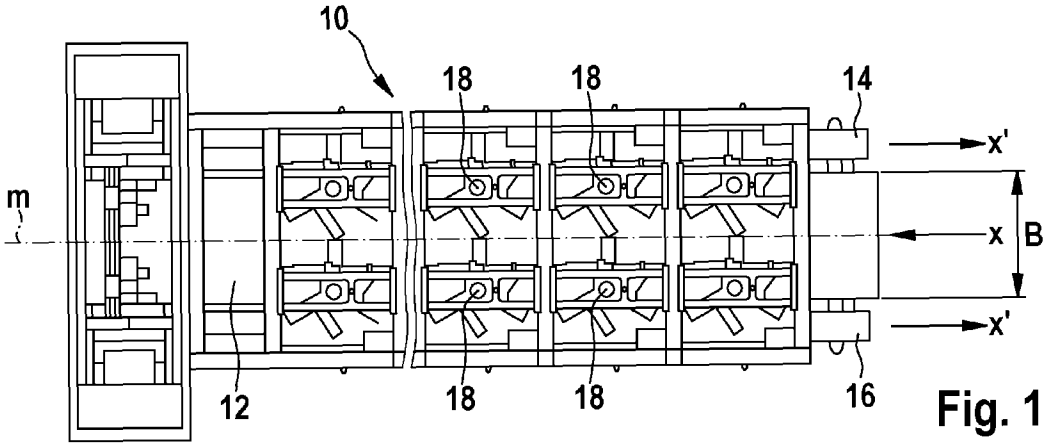
FIG. 1 shows the plan view of the conventional installation with a parallel arrangement of article and set-down-position conveyors.

An installation or robot processing line 10 which is shown in FIG. 1, and is intended for transferring articles, has an article conveyor 12, which is arranged in a transporting direction x, with set-down-position conveyors 14, 16 arranged on either side of the article conveyor 12. The article conveyor 12 and set-down-position conveyors 14, 16 are usually transporting belts, plate chains or transporting chains. The transporting direction x' of the set-down-position conveyors 14, 16, arranged parallel to the article conveyor 12, here is counter to the transporting direction x of the article conveyor 12, i.e. the installation operates in counterflow. On either side of a longitudinal center m of the article conveyor 12, robots are arranged along the robot processing line 10 or robots 18 are arranged along the latter in pairs and symmetrically in relation to the longitudinal center m. The operating range of each robot 18 extends from one of the set-down-position conveyors 14, 16 approximately to the longitudinal center m of the article conveyor 12.

Figure 2:
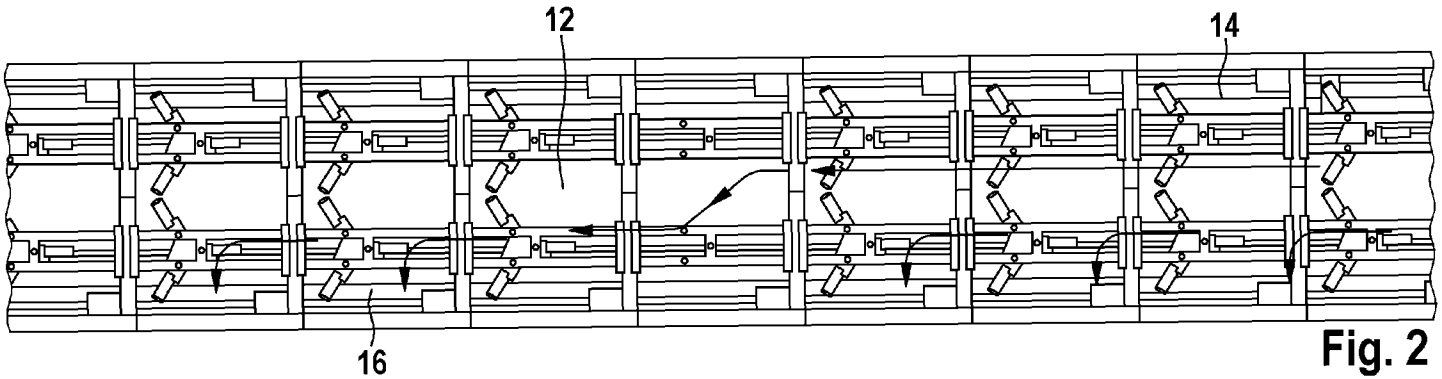
FIG. 2 shows the plan view of part of an installation with a crossover belt system during stoppage of a removal belt.

FIG. 2 shows the side-to-side changeover of articles on the article conveyor 12 of the robot processing line 10 in the case of a crossover belt system during stoppage of one of the set-down-position conveyors 14, 16. In the example shown, the set-down-position conveyor 14 is stationary.

Figure 3:
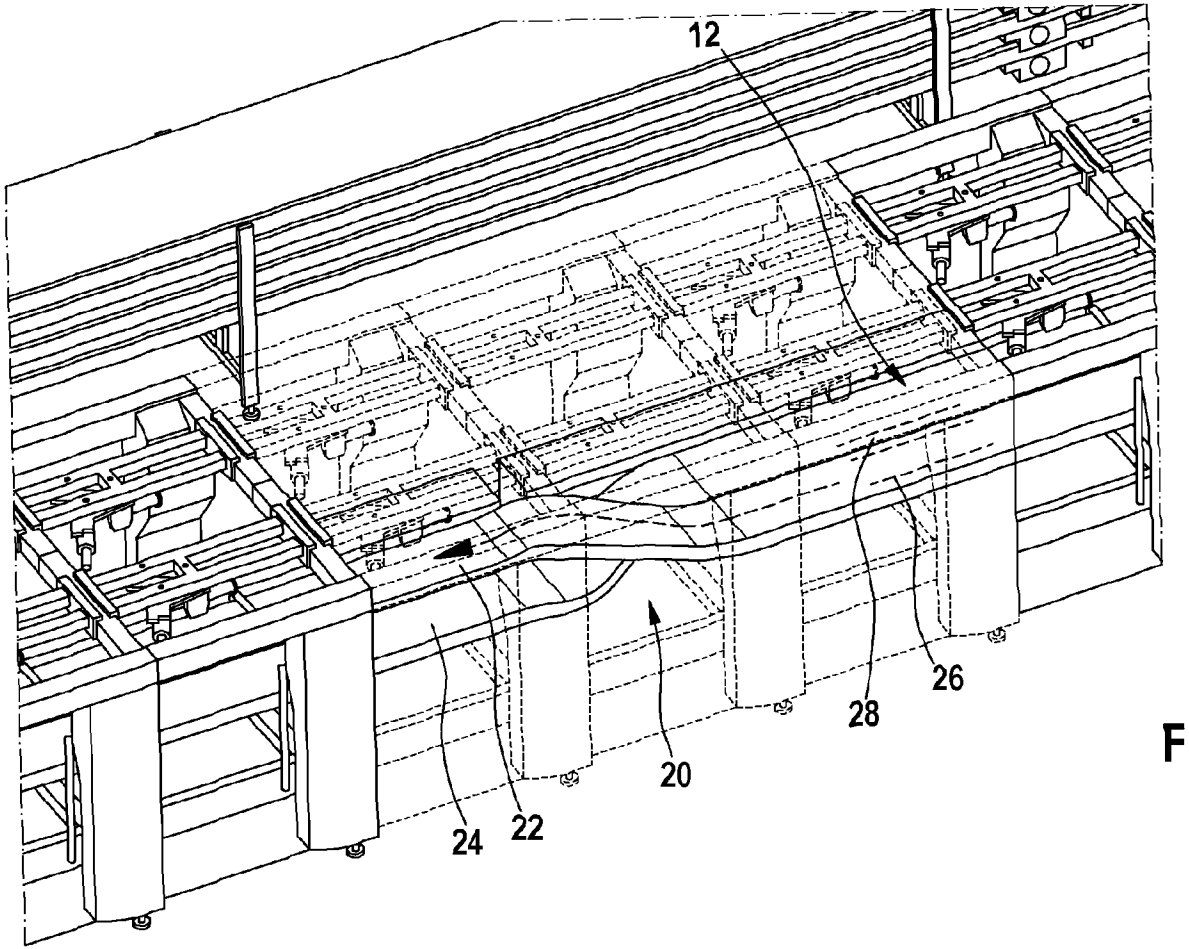
FIG. 3 shows an oblique view of a crossover belt system within a packaging installation with parallel product stream and removal systems.
Figure 4:
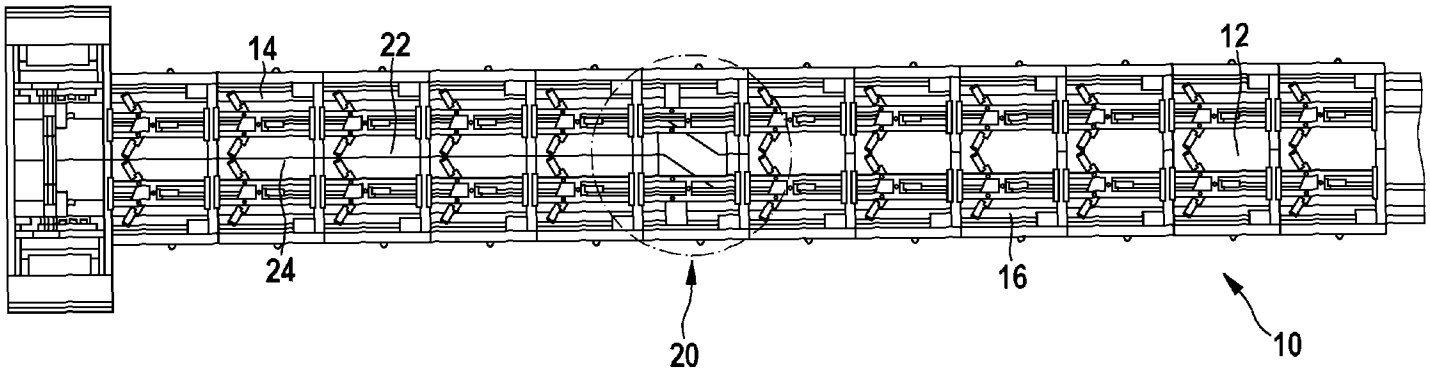
FIG. 4 shows the plan view of an installation with a crossover belt system.

The belt crossover 20, which is illustrated in FIGS. 3 and 4, is integrated in the robot processing line 10 preferably approximately halfway along the loading route. This gives rise to the same picking conditions along the entire route.

In order to allow the necessary running properties at the belt crossover 20, a modular belt or the like is necessary as the transporting means. Up to the crossover location, use can be made of the production-process transporting system. The transition from the transporting belt to the modular belt is possible in the flow direction with a knife edge along the transporting belt.

Downstream of the belt crossover 20, it is optionally possible for the modular belts 22, 24 to be continued or for other transportation systems to be used.

Continuing the two strands downstream of the crossover location is advantageous. It is thus possible for the belt system to be stopped on one side and thus for one side of the belt system to be stopped for single-sided production stoppage. The products, as far as possible, are maintained here.

The first two robots or robots 18 can be arranged further inward in order for the operating range to be utilized to better effect. They have the task of clearing away the articles from the center of the article conveyor 12.

The task of freeing the center can also be realized in some other way—e.g. by spreading out the carpet of products or by a kind of stationary or oscillating wedge.

Normal Operation

The robots upstream of the crossover location clear the outer regions (in each case the outermost quarter) of the respective product-belt side. The products in the center of the belt in each case are brought to the outside by the crossover location. Downstream of the crossover, the robots downstream of the crossover location, once again, can clear the outer regions of the respective product-belt side.

Operation with a Removal Belt Stationary

The speed of the product belt is reduced (e.g. to 60%). Remaining products run into a store. Robots on the operating side empty this product-belt half completely upstream of the crossover location. Downstream of the crossover location, the products are on the opposite side and can be cleared away by the following robots.

LIST OF DESIGNATIONS

10 Robot processing line
12 Article conveyor
14, 16 Set-down-position conveyors
18 Robot
20 Crossover location
22, 24 Modular belts
26 Peripheral regions of 12
28 Regions of 12 on either side of m
B Width of 12
x Transporting direction of the article conveyor
x' Transporting direction of the set-down-position conveyors
m Longitudinal center of 12

The invention claimed is:

1. A method wherein articles from at least one article conveyor (12), which runs in a transporting direction (x), are transferred into set-down positions of at least one set-down-position conveyor, said set-down position conveyor running in the transporting direction (+x', −x') which is the same as, or counter to, the transporting direction (x) of the article conveyor/s; further comprising a robot processing line (10) with robots (18) arranged on one side of a longitudinal center (m) of the article conveyor/s (12) of a certain width (B) wherein, each robot (18) has a picking region extending from a center (m) of the article conveyor/s (12) to an edge of the article conveyor (12), the method comprising:

the robots (18) picking the articles from the article conveyor/s (12); and setting the articles down in set-down positions on the set-down-position conveyors (14, 16);

wherein during passage through the robot processing line (10), at least some of the articles on one side of the longitudinal center (m) of the robot processing line (10), are transported, transversely to the transporting direction (x) of the article conveyor/s (12), and onto the other side of the longitudinal center (m) of the article conveyor/s (12); wherein the articles are moved into the picking region of the robots (18) arranged on the other side of the longitudinal center (m) of the article conveyor/s (12).

2. The method as claimed in claim 1, wherein at least some of the articles are transported at least into the region of the longitudinal center (m).

3. The method as claimed in claim 2, wherein some of the articles are transferred from the one side to the other side of the longitudinal center (m) of the article conveyor/s (12).

4. The method as claimed in claim 1, wherein transportation in the direction transverse to the transporting direction (x) of the article conveyor/s (12) is carried out by a transporting system (20).

5. The method as claimed in claim 1, wherein transportation in the direction transverse to the transporting direction (x) of the article conveyor/s (12) is carried out by transporting systems (22, 24) which cross over one another.

6. The method as claimed in claim 1, wherein transportation in the direction transverse to the transporting direction (x) of the article conveyor/s (12) is carried out on a permanent basis.

7. The method as claimed in claim 1, wherein transportation in the direction transverse to the transporting direction (x) of the article conveyor/s (12) is carried out only during, or just prior to, stoppage of one side of the set-down-position conveyors (14, 16).

8. The method as claimed in claim 1, wherein the robots (18) pick only articles in peripheral regions (26) of the article conveyor/s (12); and, transportation of the articles in the direction transverse to the transporting direction (x) of the article conveyor/s (12) is utilized for displacement out of a region (28) on either side of the longitudinal center (m) of the article conveyor/s (12) into the peripheral regions (26) of the article conveyor/s (12).

9. The method as claimed in claim 8, wherein the width of the peripheral regions (26, 28) corresponds approximately to a quarter of the width (B) of the article conveyor/s (12).

10. The method as claimed in claim 1, wherein the articles located in the operating range of the robots (18) arranged on the side of a stationary set-down-position conveyor (14) are brought by these robots into the operating range of robots (18) of the operating set-down-position conveyor (16).

11. The method as claimed in claim 1, wherein at least two different articles are transported simultaneously on the article conveyor/s (12);

the robots (18) upstream of that location of the robot processing line (10) at which the articles are transported, transversely to the transporting direction (x) of the article conveyor/s (12), into the picking region of the robots (18) arranged on the other side of the longitudinal center (m) of the article conveyor/s (12) pick articles at least of a first type, and set them down in a corresponding number of first set-down positions on the set-down-position conveyors (14, 16); and, the robots (18) downstream of that location of the robot processing line (10) at which the articles are transported, transversely to the transporting direction (x) of the article conveyor/s (12), into the picking region of the robots (18) arranged on the other side of the longitudinal center (m) of the article conveyor/s (12) pick articles at least of a second type, and set them down in a corresponding number of second set-down positions on the set-down-position conveyors (14, 16).

12. An installation for transferring articles, comprising:

a robot processing line (10) with at least one article conveyor (12), which runs in a transporting direction (x);

at least one set-down-position conveyor (14, 16), which runs in the transporting direction (+x', −x') which is the same as, or counter to, the transporting direction (x) of the article conveyor/s (12); and, robots (18), for picking the articles from the article conveyor/s (12) and setting the articles down in set-down positions on the set-down-position conveyors (14, 16), the robots are arranged on either side of a longitudinal center (m) of the article conveyor/s (12) of a certain width (B), each robot (18) having a picking region extending from a center (m) of the article conveyor/s (12) to an edge of the article conveyor (12), wherein one side of the longitudinal center (m) of the robot processing line (10) has at least one transporting system for transporting the articles, transversely to the transporting direction (x) of the article conveyor/s and (12), onto the other side of the longitudinal center (m) of the article conveyor/s (12); wherein the articles are moved into the picking region of the robots (18) arranged on the other side of the longitudinal center (m) of the article conveyor/s (12).

13. The installation as claimed in claim 12, further comprising two transporting systems (22, 24) which cross over one another.

* * * * *

UNITED STATES PATENT AND TRADEMARK OFFICE

CERTIFICATE OF CORRECTION

PATENT NO. : 8,718,816 B2
APPLICATION NO. : 13/389695
DATED : May 6, 2014
INVENTOR(S) : Sutter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 124 days.

Signed and Sealed this
Twenty-ninth Day of September, 2015

Michelle K. Lee

Michelle K. Lee
*Director of the United States Patent and Trademark Office*